US008676387B2

(12) United States Patent
Malakhova et al.

(10) Patent No.: US 8,676,387 B2
(45) Date of Patent: Mar. 18, 2014

(54) METHODS AND SYSTEMS FOR DETERMINING OPERATING STATES OF PUMPS

(75) Inventors: Olga Malakhova, Minden, NV (US); John Wesley Grant, Gardnerville, NV (US)

(73) Assignee: General Electric Company, Schenectady, NY (US)

( * ) Notice: Subject to any disclaimer, the term of this patent is extended or adjusted under 35 U.S.C. 154(b) by 972 days.

(21) Appl. No.: 12/250,154

(22) Filed: Oct. 13, 2008

(65) Prior Publication Data

US 2010/0092307 A1 Apr. 15, 2010

(51) Int. Cl.
*F04B 49/06* (2006.01)
*G01L 3/00* (2006.01)

(52) U.S. Cl.
USPC ..... 700/282; 702/44

(58) Field of Classification Search
USPC ..... 417/44.3; 702/44
See application file for complete search history.

(56) References Cited

U.S. PATENT DOCUMENTS

| | | | | |
|---|---|---|---|---|
| 4,665,393 | A | 5/1987 | Wilder | |
| 5,629,870 | A * | 5/1997 | Farag et al. | 700/286 |
| 5,846,056 | A | 12/1998 | Dhindsa et al. | |
| 6,289,735 | B1 * | 9/2001 | Dister et al. | 73/579 |
| 7,010,393 | B2 * | 3/2006 | Mirsky et al. | 700/282 |
| 7,317,994 | B2 * | 1/2008 | Iyer et al. | 702/56 |
| 7,758,315 | B2 * | 7/2010 | Moskun | 417/44.3 |
| 2003/0041802 | A1 | 3/2003 | Tanaka et al. | |
| 2005/0072239 | A1 * | 4/2005 | Longsdorf et al. | 73/649 |
| 2006/0265106 | A1 | 11/2006 | Giles et al. | |
| 2007/0032966 | A1 | 2/2007 | Song | |
| 2007/0067678 | A1 * | 3/2007 | Hosek et al. | 714/25 |
| 2010/0202581 | A1 * | 8/2010 | Kitajima et al. | 376/245 |

FOREIGN PATENT DOCUMENTS

| | | | |
|---|---|---|---|
| CN | 1403626 | A | 3/2003 |
| CN | 101263499 | A | 9/2008 |

(Continued)

OTHER PUBLICATIONS

European Search Report dated Jan. 20, 2010 for Application No. 09172292.6-2315.

(Continued)

*Primary Examiner* — Kakali Chaki
*Assistant Examiner* — Walter Hanchak
(74) *Attorney, Agent, or Firm* — Cooper Legal Group, LLC

(57) ABSTRACT

Embodiments of methods and systems for monitoring of pumps are provided. According to one embodiment of the invention, there is disclosed a method for determining operating states of pumps. The method may include receiving, by a controller from a first sensor communicating with a first pump, a first vibration measurement. Further, the method may include receiving, by the controller from a second sensor communicating with a second pump, a second vibration measurement. Operating states of the first pump and the second pump may be thus determined based at least in part on comparing the first vibration measurement to a first operating condition and comparing the second vibration measurement to a second operating condition. A control action may be transmitted responsive to determining the respective operating states of the first pump and the second pump.

16 Claims, 6 Drawing Sheets

(56) References Cited

FOREIGN PATENT DOCUMENTS

| | | | |
|---|---|---|---|
| DE | 102006034478 | | 1/2008 |
| EP | 0489597 | | 6/1992 |
| JP | 10-063301 | A | 3/1998 |
| JP | 11-062846 | A | 3/1999 |
| JP | 2002-061591 | A | 2/2002 |
| WO | 2007118931 | | 10/2007 |
| WO | 2008012150 | A1 | 1/2008 |
| WO | 2008116538 | A1 | 10/2008 |

OTHER PUBLICATIONS

Office Action and Search Report from CN Application No. 200910174079.9 dated Jul. 3, 2013.

Japanese Office action dated Oct. 15, 2013. Japanese Application No. 2009-234695, translation of which will be filed at a later date.

* cited by examiner

METHODS AND SYSTEMS FOR DETERMINING OPERATING STATES OF PUMPS

FIELD OF THE INVENTION

This invention relates generally to pump systems and more specifically, to providing methods and systems for monitoring operating states of pumps.

BACKGROUND OF THE INVENTION

Pump systems such as those used in various industrial, commercial, and domestic applications, such as oil refineries, water supply, gasoline supply, and the like, may include two or more pumps to maintain the supply and level of fluid. Generally, one or more pumps in the pump system is a redundant pump and is used when additional supply is required, in case of a fault in a running pump, or to relieve the primary pump. Therefore, the use of multiple pumps increases overall system reliability and extends the time period during which any one pump may be kept in service. In most applications, redundant pumps are not instrumented with a speed detector. Further, for pump systems having a large number of pumps, it is time-consuming to manually analyze whether a pump is running or stopped. Seismic transducers may be used to monitor pump casing vibration and to determine the pump state (i.e., running or stopped).

Various methods may be used to perform data validation, calculation, analysis, and detection of specific events and malfunctions in machines. An existing method compares the overall (peak-to-peak or direct) vibration level observed by a seismic transducer associated with the pumps against a preconfigured on-state threshold value (i.e., a value at or above which the pump is in a running state) to determine whether the pump is running or stopped. Typically, manual analysis is done on historical data of vibration measurements collected over a period of several months to set the on-state threshold value. Therefore, various man hours are required to collect data and configure the on-state threshold values of the pumps.

Generally, multiple pumps may be installed on a common foundation. In this case, appropriate setting of the on-state threshold value based on seismic data becomes even more difficult and time-consuming due to the required detailed analysis of the historical data. Moreover, vibrations from a running pump may be transferred to a stopped pump. Subsequently, the stopped pump may have substantially higher vibration level than expected for a pump in a stopped state. Thus, simple identification of overall vibration levels for a pump does not necessarily indicate that a higher level of vibrations is for a running state. Moreover, a lower level of vibration in a stopped pump may be due to environmental vibrations, even when all pumps on the common foundation are stopped. Further, there may be change in the higher or lower vibration of the running pump due to the changing pump conditions, such as bearing deterioration or imbalance. As a result, the on-state threshold value that had been set previously may be no longer accurate, and using it may lead to erroneous results.

Accordingly, there is a need for methods and systems for monitoring operating states of pumps. There is a further need for automatic determination and calculation of on-state threshold of vibrations of pumps and for updating the on-state threshold of vibrations in real time or near real time for more accurate pump diagnostics. Additionally, there is a need for methods and systems that calculate the threshold values online by using the recently collected data.

BRIEF DESCRIPTION OF THE INVENTION

According to one embodiment of the invention, there is disclosed a method for monitoring a plurality of pumps. The method may include receiving a first vibration measurement by a controller from a first sensor in communication with a first pump during a period of time. The method may further include receiving a second vibration measurement by the controller from a second sensor in communication with a second pump during the same period of time. The method may then include determining respective operating states of the first pump and the second pump during the same time period based at least in part on comparing the first vibration measurement to a first operating condition, and comparing the second vibration measurement to a second operating condition. The first operating condition and the second operating condition may be adjusted by the controller based on respective vibration measurements of the first pump and the second pump. A control action may be transmitted responsive to determining the respective operating states of the first pump and the second pump.

According to another embodiment of the invention, there is disclosed a system for monitoring a plurality of pumps. The system may include a first sensor in communication with a first pump, a second sensor in communication with a second pump, and a controller in communication with the first sensor and the second sensor. The controller may be operable to receive a first vibration measurement from the first sensor during a period of time, and receive a second vibration measurement from the second sensor during the same time period. Further, the controller may determine respective operating states of the first pump and the second pump during the same time period based at least in part on comparing the first vibration measurement to a first operating condition, and comparing the second vibration measurement to a second operating condition. The controller may be operable to adjust the first operating condition and the second operating condition based on respective vibration measurements of the first pump and the second pump. A control action may be transmitted responsive to determining the respective operating states of the first pump and the second pump.

According to yet another embodiment of the invention, there is disclosed a method for monitoring a pump. The method may include receiving, by a controller from a sensor in communication with a pump, a vibration measurement during a period of time, and determining an operating state of the pump during the period of time based at least in part on comparing the vibration measurement to at least one operating condition, wherein the controller is operable to adjust the at least one operating condition based on vibration measurement of the pump. The method may further include transmitting a control action responsive to the operating state of the pump.

Other embodiments, aspects, and features of the invention will become apparent to those skilled in the art from the following detailed description, the accompanying drawings, and the appended claims.

BRIEF DESCRIPTION OF THE DRAWINGS

Figure 1:
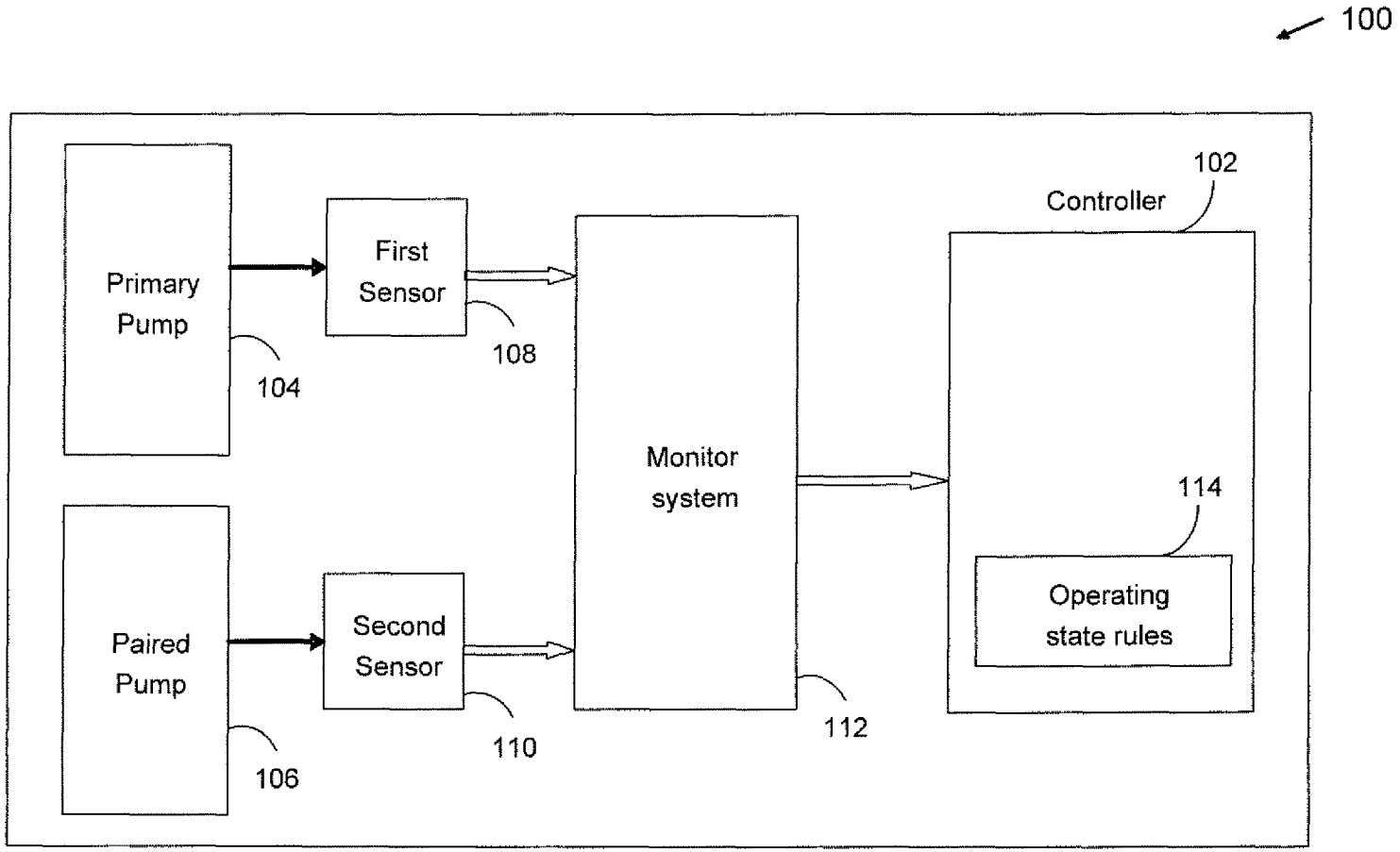

Having thus described the invention in general terms, reference will now be made to the accompanying drawings, which are not necessarily drawn to scale, and wherein:

FIG. 1 is a schematic representation of an example system for monitoring and controlling a plurality of pumps, in accordance with one embodiment of the invention.

Figure 2:
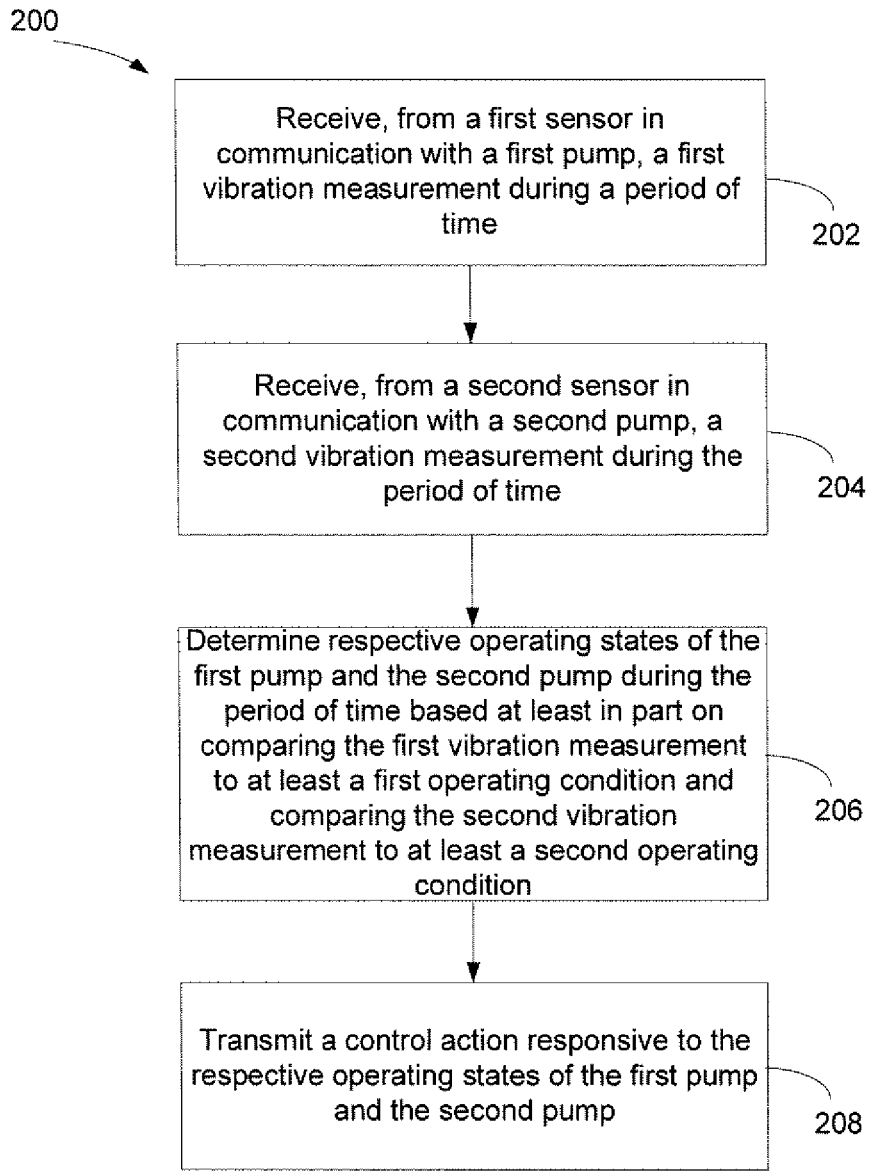

FIG. 2 is a flowchart illustrating one example method for determining operating states of a plurality of pumps, in accordance with one embodiment of the invention.

Figure 3A:
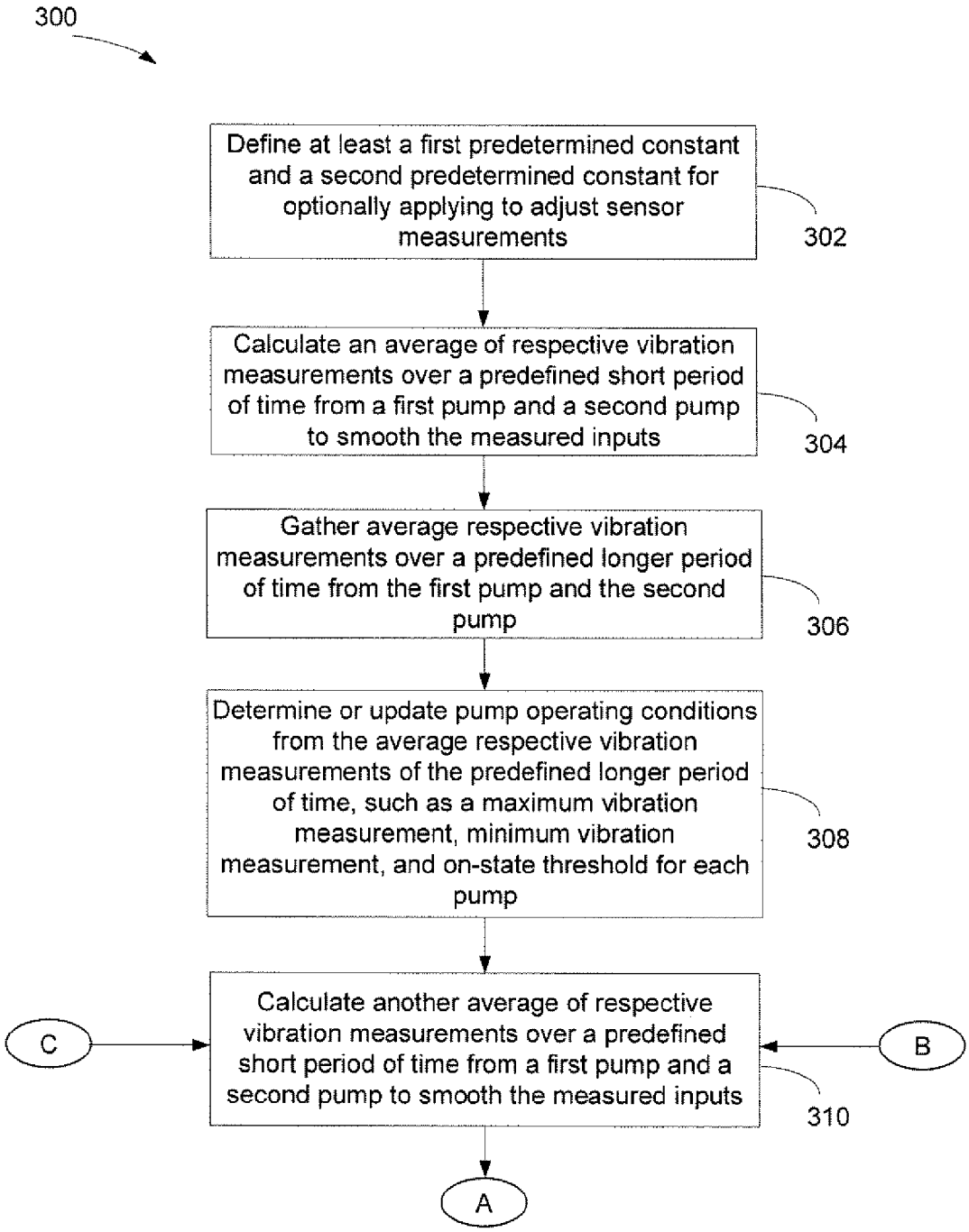
Figure 3B:
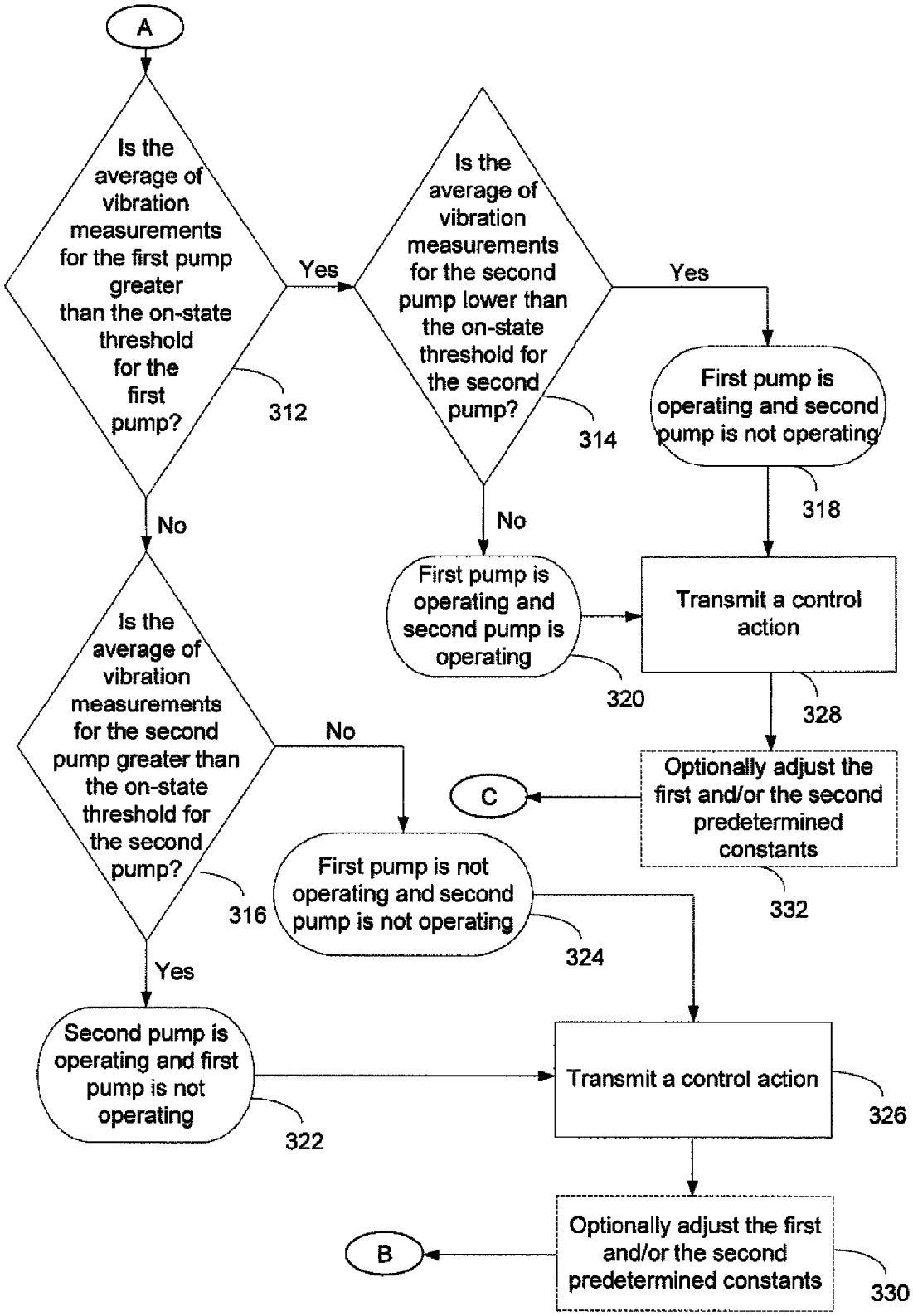

FIGS. 3A and 3B is a flowchart illustrating one example method for determining operating states of a plurality of pumps, in accordance with one embodiment of the invention.

Figure 4:
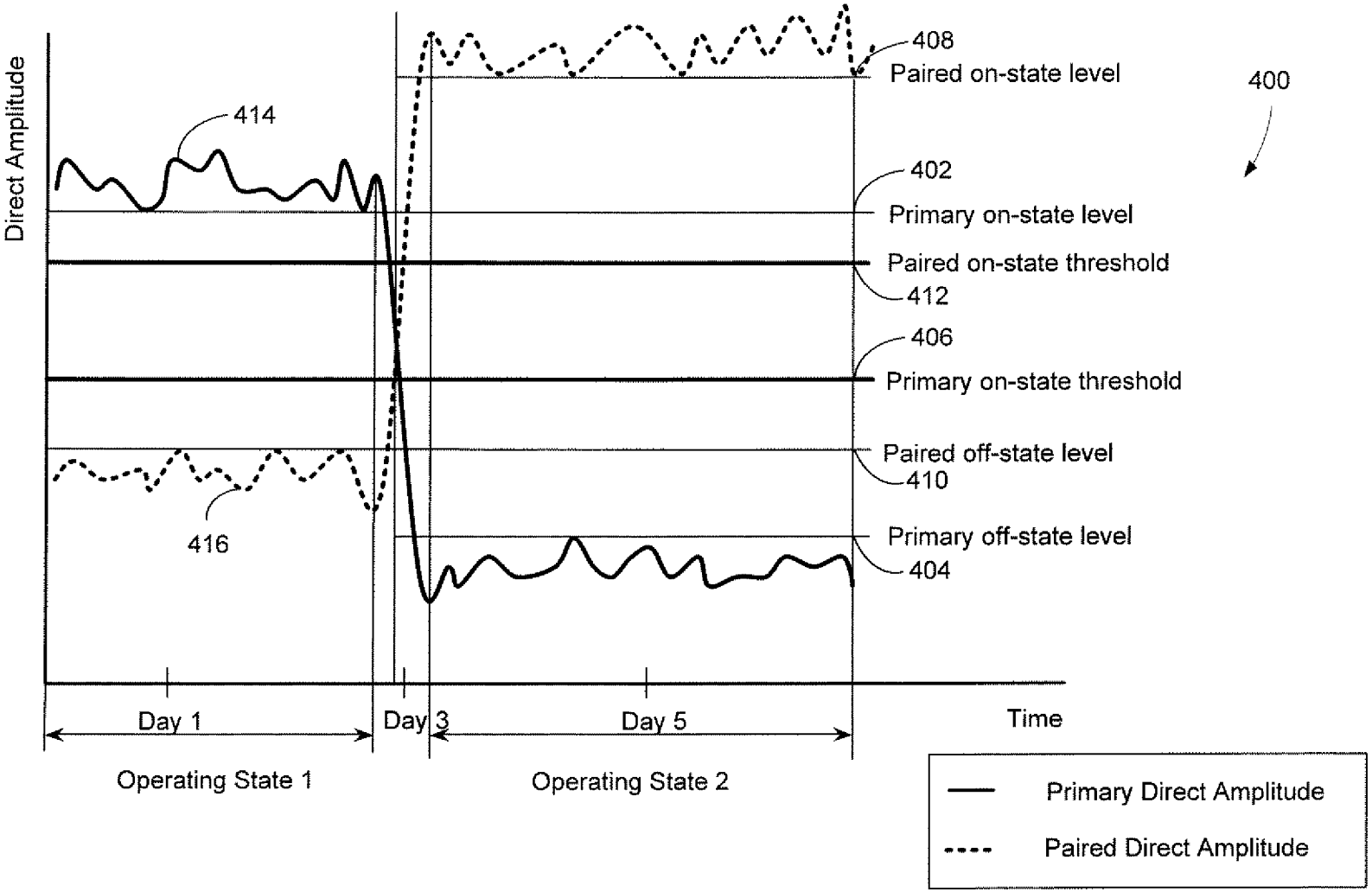

FIG. 4 is a graphical representation of example vibration levels of two pumps based on their operating states, in accordance with one embodiment of the invention.

Figure 5:
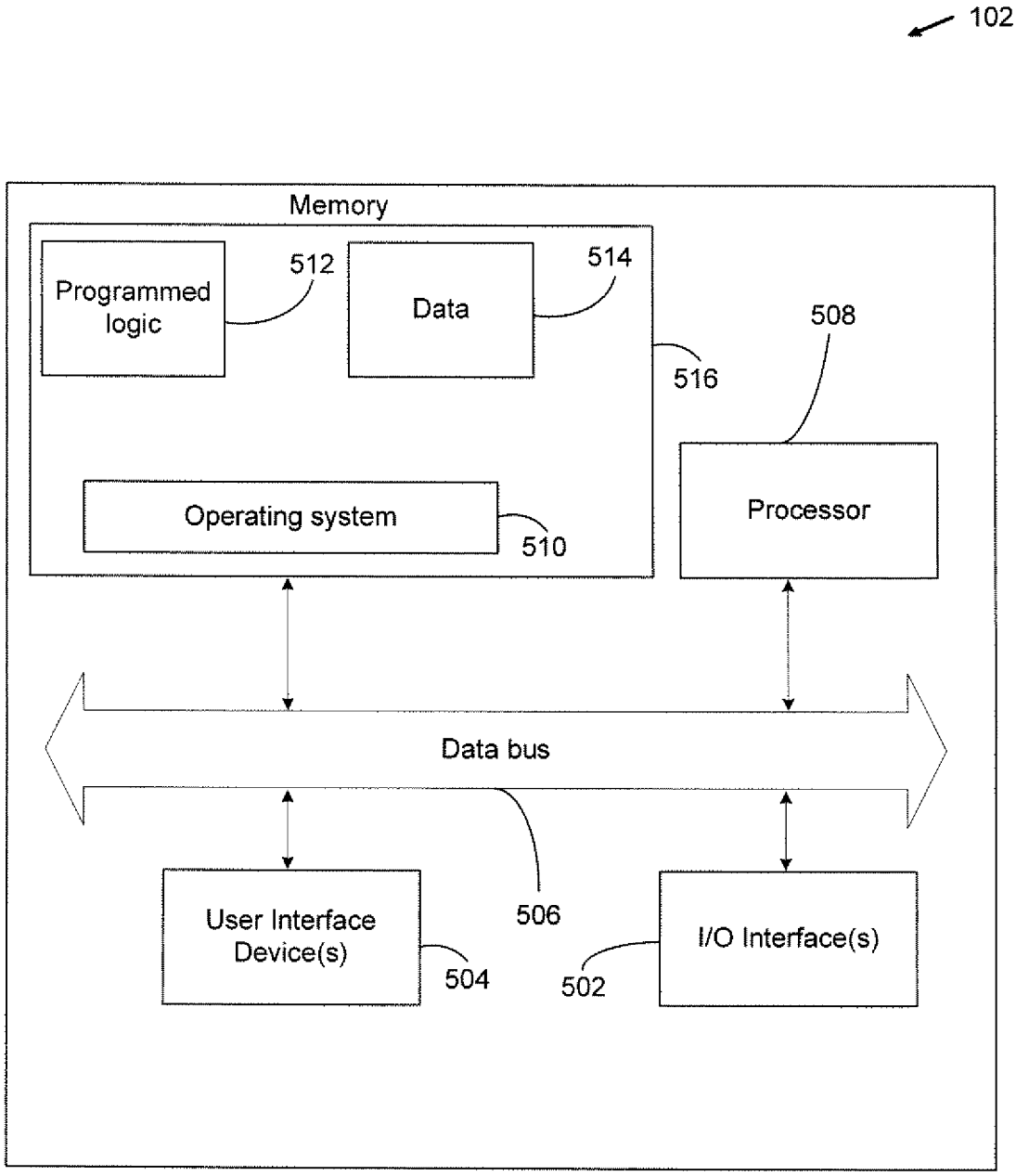

FIG. 5 is a schematic representation of an example controller in electrical communication with a plurality of pumps, in accordance with one embodiment of the invention.

DETAILED DESCRIPTION OF THE INVENTION

Illustrative embodiments of the invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Disclosed are methods and systems for determining pump operating states, which may be based on overall vibration collected from sensors. According to one embodiment of the invention, vibration measurements may be received by a controller from sensors connected to each pump. The controller may receive these measurements during a certain time period. Further, during this time period, the controller may use the received information to determine operating states of these pumps. The controller may at least compare a first received vibration measurement to a first operating condition and a second received vibration measurement to a second operating condition. The operating conditions may be defined as a threshold that is based at least in part on an average of at least one historical minimum vibration measurement of the pump when operating (or running) and at least one historical maximum vibration measurement of the same pump when not operating (or stopped). As used herein, the term "historical minimum vibration measurement" may be used to generally refer to a lowest or a substantially low vibration measurement sensed from a pump (or other device) over a period of time when the pump is operating. Similarly, as used herein, the term "historical maximum vibration measurement" may be used to generally refer to a highest or a substantially high vibration measurement sensed from a pump (or other device) over a period of time when the pump is operating. The "historical minimum vibration measurement" and the "historical maximum vibration measurement" may be relative terms, whereby the "minimum" and "maximum" are determined relative to other measurements of the respective pump when operating during the same period of time. The controller may be operable to adjust the first and second operating conditions used for comparison based on respective vibration measurements of the pumps over time. The controller may then transmit a control action responsive to determining the respective operating states of each pump. The control action may be further be used to diagnose running pumps. Although systems and methods for monitoring a plurality of pumps are described in detail herein, systems and methods for monitoring a single pump may also be employed, and are within the scope of that described herein and within the scope of the appended claims.

FIG. 1 is a schematic representation of an example system 100 for monitoring and controlling a plurality of pumps, in accordance with one embodiment of the invention. Pump systems, such as those used in various industrial, commercial, and domestic applications, like oil refineries, water supply, gasoline supply, and the like, may include two or more pumps to maintain the supply and level of fluid. The controller 102 may be used to activate and de-activate, or otherwise control the operation of the pumps. The controller 102 may be either a hardware device, a software module, or a combination thereof.

Embodiments of the invention may include any number of pumps installed on a common foundation. For illustrative purposes, one example is shown in the FIG. 1, in which the system 100 may include a first pump 104 and a second pump 106. These pumps may be installed on a common foundation. In such a case, the first pump 104 is hereinafter referred to as the primary pump 104 and the second pump 106 is hereinafter referred to as the paired pump 106. As used herein, the terms "first pump" and "primary pump" may be used interchangeably to refer to one pump of a plurality of pumps, and the terms "second pump" and "paired pump" may also be used interchangeably to refer to another pump of the plurality of pumps, which may be configured to operate in coordination with the "primary pump." In the example embodiment shown in FIG. 1, the primary pump 104 and the paired pump 106 may be centrifugal pumps. In another example embodiment, the primary pump 104 and the paired pump 106 may be any pump compliant with American Petroleum Institutes (API) standards, for example. Also, in other embodiments, an example system may include a single pump.

Embodiments of the invention may include any number of sensors installed on a single pump. For example, as shown in the FIG. 1, the system 100 may include a first sensor 108 installed on or in communication with the casing of the primary pump 104 and a second sensor 110 installed on or in communication with the casing of the paired pump 106. In one embodiment of the invention, the first sensor 108 and the second sensor 10 are vibrations sensors, such as seismic transducers. In another embodiment, each of the first sensor 108 and the second sensor 110 may include an accelerometer to detect vibrations caused by the primary pump 104 and the paired pump 106.

Further, a controller 102, which may be any processor based and/or hardware based controller operable to execute instructions and perform operations on sensed data, may be used to determine operating states of the primary pump 104 and the paired pump 106. In one example, the operating state of the pump may be running or stopped. In other example embodiments, the operating states may include various relative operating conditions, such as may be reflective of pump speed, output, and the like. The controller 102 may be external to, integrated with, or attached to, the primary pump 104 and/or the paired pump 106.

Generally, vibrations from a running pump may be transferred to a stopped pump when they are installed on a common foundation. Moreover, each machine installation may differ in terms of operating behaviors, thus vibration levels on one installation may be entirely different from vibration levels on another installation. Thus, the simple detection overall levels of vibration for a pump and comparison to generally determined predefined constants may not accurately indicate the operating state of a specific pump in a specific installation. In one example, a monitor system 112 may be deployed in the system 100 to receive the vibration signals (or measurements) from the sensors 108 and 110 during a certain period of time. The period of time may be real time or near real time, in accordance with an example embodiment of the invention. Thereafter, the monitor system 112 may relay the received/monitored vibration measurements to the controller 102. In one embodiment of the invention, the monitor system 112 may continuously receive vibration signals from the sensors 108 and 110. In another embodiment of the invention, the monitor system 112 may periodically receive vibration signals from the sensors 108 and 110, such as over set monitoring periods.

The controller 102 may then determine the operating states of the pumps 104 and 106 based on analysis performed using the vibration signals. According to an embodiment of the invention, the controller 102 may apply operating state rules 114 to correctly determine which of the pump(s) is/are in a running state. As shown in the FIG. 1, the operating state rules 114 may be embedded in the controller 102, though they may be stored external to the controller and accessible by way of one or more communication means and input/output devices. Example rules will be described in detail in conjunction with FIGS. 3A and 3B, though any logic may be applied comparing the operation of the a primary pump 104 and a paired pump 106 to historical pump measurements, and that provides the capabilities to adjust the rules and operating conditions over time responsive to machine changes. The interconnection of the pumps 104 and 106, the sensors 108 and 110, the monitor system 112, and the controller 102 is provided in FIG. 1 for illustrative purposes only, and it should be understood that other interconnections and configurations can be used. When determining an operating state of only a single pump, that pump's vibration measurements may be compared to operating conditions, which may be predefined and/or based on that pump's historical operation and vibration measurements, in a manner similar to those described herein with reference to system s including multiple pumps.

FIG. 2 is a flowchart illustrating one example method 200 for determining operating states of a plurality of pumps, in accordance with one embodiment of the invention, such as for determining the operating states of a primary pump and a paired pump installed on a common foundation.

The example method 200 begins at block 202. At block 202, a controller may receive a first vibration measurement or measurements taken over a predefined period of time from a first sensor in communication with a primary pump. The first sensor may be a transducer installed on the casing of the primary pump. The controller may receive the first vibration measurement when vibrations are generated due to operation of the primary pump. Further, the controller may receive the first vibration measurement when vibrations are transferred to the primary pump due to operation of the paired pump installed on the same foundation as the primary pump. In one example embodiment, the controller may receive the first vibration measurement via a monitor system in communication with the sensors and the controller, as described with reference to FIG. 1.

Following block 202 is block 204, in which a second vibration measurement or measurements taken over the predefined period of time (i.e., same as that period of time described for block 202) may be received by the controller from a second sensor in communication with a paired pump. In an embodiment of the invention, the first vibration and second vibration measurements are taken in real time or near real time. Similar to the first sensor, the second sensor may also be a transducer installed on the casing of the paired pump. In one example embodiment, the controller may receive the first vibration measurement via a monitor system in communication with the sensors and the controller, as described with reference to FIG. 1.

In certain situations, detection of two or more vibration levels for a pump may not be sufficient to correctly determine the operating state of the pump. Thus, the controller may apply additionally process or analyze the first and second vibration measurements received from the first and second sensors to determine the correct operation state of the pump. Example additional processing or analyses techniques are described in more detail with reference to FIGS. 3A and 3B.

Following block 204 is block 206, in which the controller may apply operating state rules to the first vibration measurement and the second vibration measurement. The operating state rules may allow the controller to determine the operating states of the primary pump and the paired pump over the predefined period of time. In one embodiment of the invention, the controller may compare the first vibration measurement to at least a first predefined or predetermined operating condition in order to determine the operating state of the primary pump. For example, the controller may initially determine the operating condition by analyzing received vibration measurements, and identify one or more operating conditions to be used for subsequent operating state determinations. For example, the first operating condition may be a first threshold associated with the primary pump, which may be hereinafter referred to as the "primary on-state threshold." A primary on-state threshold may define a vibration level of the primary pump, above which it may be concluded that the primary pump is in a running operating state. Over time, this vibration level may change, due to machine degradation, operating changes, and the like; and thus this first operating condition/threshold associated with the primary pump may be adjusted to at least partially account for machine changes.

Similarly, in another embodiment of the invention, the controller may compare the second vibration measurement to at least a second predefined or predetermined operating condition in order to determine the operating state of the paired pump. Similar to that determined for the primary pump, the second operating condition may be a second threshold associated with the paired pump, which may be hereinafter referred to as the "paired on-state threshold." One example technique used to determine the paired on-state threshold and the primary on-state threshold is described in more detail with reference to FIGS. 3A and 3B.

In accordance with one embodiment of the invention, the controller may compare the vibration measurements from the primary pump to the vibration measurements of the paired pump. In other words, in this example embodiment, the first operating condition may represent the vibrations of the paired pump taken over the same period of time, and the second operating condition may represent the vibrations of the primary pump taken over the same period of time. Thus, in some example embodiments, comparison of one pump's vibrations to another's may be sufficient to determine pump operating conditions.

Following block 206 is block 208, in which the controller may generate and/or transmit control actions based on the operating states of the primary pump and the paired pump to a system. Control actions may include information to facilitate running diagnostics for rectifying malfunctions like imbalance, alignment, and deterioration, for example, or direct alteration of the pump operations to rectify such faults In one embodiment of the invention, malfunctioning may be evaluated only when the operating state of the pump is determined to be running. The system to which the control actions may be transmitted include another controller, such as is described herein for detecting pump operating states, a controller for controlling the machine operations, a monitoring/reporting system monitored by an operator who takes appropriate action on the basis of the control actions, such as information, statistics, diagnosis determinations, fault determinations, another component associated with the machine, and/or another machine or system used in other aspects of the plant operations. For example, if a pump from a pair of pumps is determined to be stopped or running, the controller may provide data that enables a recommendation to the operator to turn on the running pump or turn off the running pump as per the requirement. In yet another embodiment of the invention, the system and the controller may be one in the same, and execute the operating state rules to determine the operating states of the primary and paired pumps as well as generate control actions to control or otherwise alter pump or other system operation.

FIGS. 3A and 3B illustrate a flowchart illustrating one example method 300 for determining operating states of a plurality of pumps, in accordance with one embodiment of the invention. The flowchart illustrates an example of determining the operating states of a primary pump and a paired pump installed on a common foundation by applying operating state rules on the vibration measurements received from the sensors of the pumps.

The example method 300 begins at block 302. In block 302, at least a first predetermined constant and a second predetermined constant may be defined, which may be optionally applied during processing to adjust vibration measurements as sensed. The constants are defined in more detail later with reference to 'operating state 1' and 'operating state 2,' as explained with reference to FIG. 4. In accordance with one embodiment of the invention, the first predetermined constant is based at least in part on historical vibration measurements of the primary pump and the second predetermined constant is based at least in part on historical vibration measurements of the paired pump. These constants may be used in the operating state rules when determining the operating states of the pumps, such as to apply a factor to and/or adjust initial measurements when analyzing the initial measurements and/or when determining the operating states of the pump. In one embodiment, the constants may have predefined default values; though, an operator may override the default values. In case the operator does not set the values of the constants, then the default values may be used. In an exemplary embodiment of the invention, the first and the second predetermined constants may include a Primary On Versus Paired Off Percent constant for identifying operating state 1, a Paired On Versus Primary Off Percent constant for identifying operating state 2, a Primary On-state Deviation Percent constant for determining that the operating state 1 has existed continuously for a period of time, such as for three hours, a Primary Off-state Deviation Percent constant for determining that the operating state 2 has existed continuously for a period of time, such as for three hours, a Paired On-state Deviation Percent for determining that the operating state 2 has existed continuously for a period of time, such as for three hours, a Paired Off-state Deviation Percent constant for determining that the operating state 1 has existed continuously for a period of time, such as for three hours, and/or a Minimum On/Off Difference constant for complementing using Primary On versus Paired Off percent and Paired On versus Primary Off percent such that it helps avoid situations when both pumps are stopped (but may have statistically different low direct levels). The default values of the constants may be any numerical value, which may be set depending upon its purpose, based on previous pump operation data, based on iterative analyses, arbitrarily, and the like.

Following block 302 is block 304, in which an average of vibration measurements received from a first sensor associated with a primary pump and an average of the vibration measurements received from a second sensor associated with a paired pump over a predefined short period of time may be calculated. In an embodiment of the invention, these averages may be calculated to smooth the measured vibration inputs received as inputs from the primary and paired pumps. In one example, the predefined short period of time may be determined as a factor of the data sampling rate. In one example embodiment, the predefined short period of time may be approximately three minutes. Though it is appreciated that any period of time may be used as the predefined short period of time, for example ranging from seconds to hours, depending upon the particular installation and analysis techniques. The average calculated for the primary pump may be hereinafter referred to as the "primary pump direct average" and the average calculated for the paired pump may be hereinafter referred to as the "paired pump direct average." In the one example embodiment in which the predefined short period of time is approximately three minutes, an average calculated over a three minutes time period for the primary pump is hereinafter referred to as the "primary 3 minute average" (also a "first average") and the average calculated over the three minutes time period for the paired pump is hereinafter referred to as the "paired 3 minute average" (also "a second average"). The primary pump direct average, paired pump direct average, primary 3 minute average, and paired 3 minute average may be used to smooth the pump vibration measurements directly measured to avoid comparing spikes or troughs that may be unrepresentative of the actual pump operation.

Following block 304 is block 306, in which vibration measurements over a predefined longer period of time from the primary pump and the paired pump may be gathered. In one example embodiment in which primary pump direct averages and paired pump direct averages are calculated, the vibration measurements taken over the longer period of time may be measurements of the primary pump and paired pump direct averages aggregated over the longer period of time. The "predefined short period of time" and the "predefined longer period of time" may also be hereinafter interchangeably referred to as the "first period of time" and the "second period of time," respectively. The predefined longer period of time may also be determined as a factor of the data sampling rate. In one example embodiment, the predefined longer period of time may be approximately three hours. Though it is appreciated that any period of time may be used as the predefined longer period of time, for example ranging from seconds to hours, depending upon the particular installation and analysis techniques.

In one embodiment of the invention, an on-state level and an off-state level of a pump may be determined using historical vibration measurements collected over the longer time period. The on-state level refers to a minimum level of vibration measurement detected during a certain period of time, when the pump is in a running state. Similarly, the off-state level refers to a maximum level of vibration measurement detected during a certain period of time, when the pump is stopped.

In various embodiments of the invention, the controller may apply additional processing to the vibration measurements (e.g., the first and second vibration measurements) received from the sensors (e.g., the first and second sensors). The additional processing may include scaling, factoring, or any other additional adjustments. In accordance with one example embodiment, the controller may adjust the first vibration measurement based at least in part on the first predetermined constant, and the second vibration measurement based at least in part on the second predetermined constant, in which the first and the second predetermined constants may be some or all of the predetermined constants defined in block 302.

Following block 306 is block 308, in which the controller may determine and/or update pump operating conditions based on the average respective vibration measurements of the predefined longer period of time. The operating conditions may be used for comparison to the vibration measurements received by the controller to determine the operating states of pumps. In one example, the controller may take a number of consequent primary pump vibration measurements taken in block 306. For example, the controller may analyze the number of measurements taken over a predefined period of time, such as twenty four hours. The controller may then identify a minimum of the historical vibration measurements for the primary pump, which may be hereinafter referred to as the "primary on-state level." Similarly, the controller may select a maximum of the historical vibration measurements for the paired pump, which is hereinafter is referred to as the "paired off-state level." The controller may also determine the "primary off-state level" and the "paired on-state level." The paired on-state level may correspond to a minimum of the historical vibration measurements for the paired pump, and the primary off-state level may correspond to a maximum of the historical vibration measurements for the primary pump. These levels are illustrated and described in more detail with reference to FIG. 4.

In order to determine the operating condition of the primary pump, the controller may calculate the average of the primary on-state level and the primary off-state level. This average indicates a minimum value at or above which the primary pump is in running state. Therefore, this average may be hereinafter referred to as the "primary on-state threshold." Similarly, the controller may calculate the average of the paired on-state level and the paired off-state level. This average indicates a minimum value at or above which the paired pump is in running state. Therefore, this average may be hereinafter referred to as the "paired on-state threshold."

Following block 308 is block 310, in which an average of the vibration measurements received from the first sensor installed on the primary pump and an average of the vibration measurements received from the second sensor installed on the paired pump over a predefined short period of time may optionally be calculated again. In an embodiment of the invention, the averages may be calculated to smooth the measured inputs. In one example embodiment, the procedure used by the controller to determine these averages may be same as or similar to the corresponding procedure explained earlier in block 304. The average vibration measurements may be calculated again at block 310 to receive and therefore analyze the most updated pump measurements. For example, the averages obtained at block 304 may be used to generate initial pump operating conditions for subsequent analysis (such as defining thresholds and the like); whereas the averages obtained at block 310 may be analyzed in light of the operating conditions based at least in part on the earlier gathered measurements. As shown, block 310 indicates an iterative aspect of the overall method 300 to determine in real time or near real time the operating states of the pumps, while optionally updating predetermined operating conditions against which sensed data may be compared.

Following block 310 is decision block 312, in which the controller may compare the primary pump average taken at block 310 to the primary on-state threshold. If the controller determines the primary pump average is greater than the primary on-state threshold, the controller may apply the operating state rule described later in block 314. Alternatively, if the primary pump average is determined to be lower than the primary on-state threshold, then the controller may apply the operating state rule described later in block 316.

If it is determined at decision block 312 that the primary pump average taken at block 310 greater than the primary on-state threshold, then decision block 314 follows, in which the controller may compare the paired pump average to the paired on-state threshold. If the controller determines the paired pump average taken at block 310 is lower than the paired on-state threshold then block 318 follows block 314, in which the controller may determine that the operating state of the primary pump is running and the operating state of the paired pump is not running. Alternatively, if the paired pump average is taken at block 310 is determined to be greater than the paired on-state threshold then block 320 follows block 314, in which the controller may determine the operating state of both the primary and paired pumps as running.

Following blocks 318 and 320 is block 328, in which the controller may transmit control actions responsive to the respective operating states of the primary and paired pumps to the system. In one embodiment, when the block 328 follows block 318 the system may run diagnostics only on the primary pump as only the primary pump is determined to be running. Alternatively, when the block 328 follows block 320, the system may run diagnostics on both the pumps as both pumps are determined to be running. In some embodiments, if it is determined that both pumps are running, the control action generated at block 328 may be to stop operation of one or both, as this may indicate an unexpected operating state.

If it is determined at block 312 that the primary pump average taken at block 310 is determined to be lower than the primary on-state threshold, then block 316 follows, in which the controller may compare the paired pump average to the paired on-state threshold. If the controller determines the paired pump average is greater than the paired on-state threshold, then block 322 follows block 316, in which the controller determines the operating state of the primary pump as stopped and the operating state of the paired pump as running. Alternatively, if the controller determines the paired pump average taken at block 310 to be lower than the paired on-state threshold, then block 324 follows block 316, in which the controller determines the operating state of both the primary and paired pumps as stopped.

Following blocks 322 and 324 is block 326, in which the controller may transmit control actions responsive to the respective operating states of the primary and paired pumps to a system. As described earlier, the system may be a controller, which is either same as or different from the controller that executes the logic to determine the operating states of the primary and paired pumps. This system may be used to run diagnostics based on the operating states of the primary and paired pumps. If block 326 follows block 322, the system may ran diagnostics only on the paired pump as only the primary pump is determined to be running. Alternatively, if block 326 follows block 324, the system may not run diagnostics on both the pumps as both the pumps are determined to be stopped.

Optionally following block 326 is block 330 and optionally following block 328 is block 332. In blocks 330 and 332, the controller may modify the predetermined constants, such as those that are defined in block 302. In one embodiment of the invention, the modification of the constants may be done based on the actual operation of the primary and paired pumps, such as is represented by the most recent vibration measurements received by the controller. As described herein, the controller may use these modified and updated constants to determine operating states of the pumps in further operating cycles. In order to do so, the controller may once again gather respective vibration measurements over predefined longer period of time from the primary and paired pumps. In other words, the method explained in and after blocks 306 may follow hereinafter.

The example method 300 illustrated in FIG. 3 describes, for illustrative purposes only, one application of operating state rules logic that may be applied when determining the operating state of a plurality of pumps (or other machinery). However, it is appreciated that any various operating state rules logic may be employed. For example, the time periods defined, the predefined constants, the threshold levels, the various comparisons, and the like, are exemplary and may be altered and/or not applied in other embodiments.

Furthermore, the controller may also determine the operating states of other systems connected to or integrated with the pump. In an example embodiment of the invention, the faults in one or more electric motors and/or turbines driving the primary (or paired) pump may also be determined when the operating state of the corresponding pump is determined to be running. It will be apparent that when a pump is running its driver will also be in a running state. Faults in the electric motors may include non uniform air gaps, loosening of the components inside the electric motors, and bearing level faults, for example. In accordance with one embodiment of the invention, the diagnostics, such as the specific rule logic applied, for the electric motors and turbines may be different from the diagnostics for the pumps.

FIG. 4 is a graphical representation of example vibration levels of two pumps based on their operating states, in accordance with one embodiment of the invention. The example graph 400 represents amplitudes of vibration measurements received over a period of time from the primary and paired pumps. In FIG. 4, amplitudes of vibration measurements of the primary and paired pumps are plotted against time for two operating states. Here, the amplitude versus time graph illustrates trend plots. The trend plots representing the amplitude of the vibration measurements for the primary pump is shown in solid lines, and is referred to as the "primary direct amplitude" 414. Similarly, the trend plots representing the amplitude of the vibration measurements for the paired pump is shown in dashed lines, and is referred to as the "paired direct amplitude" 416.

In one example, as shown by the primary direct amplitude 414 and the paired direct amplitude 416, on day 1 the operating state of the primary pump is running and the operating state of the paired pump is stopped. This operating state of primary and paired pumps is referred to as "operating state 1." As mentioned earlier, the operating state 1 may be identified using the Primary On versus Paired Off percent constant. In one embodiment of the invention, averages, such as three minute averages of the primary direct minus the corresponding three minute average of the paired direct, divided by the three minute average of the primary direct may be calculated. The result, based on historical data analysis, may be greater than the Primary On versus Paired Off percent constant for majority of samples (for example, for at least 50 out of 60 consequent three minute average samples), when the pumps are in the operating state 1.

Similarly, on day 5 the operating state of the paired pump is running and operating state of the primary pump is stopped. This operating state of the primary and paired pumps is referred to as "operating state 2." As mentioned earlier, the operating state 2 may be identified using the Paired On versus Primary Off percent constant. In one embodiment of the invention, averages, such as three minute averages of the paired direct minus the corresponding three minute average of the primary direct, divided by the three minute average of the paired direct is calculated. The result, based on historical data analysis, may be greater than the Paired On versus Primary Off percent constant for majority of samples (for example, for at least 50 out of 60 consequent three minute average samples), when the primary and paired pumps are in the operating state 2. These two constants help avoid evaluating the thresholds in situations when both primary and paired pumps may be running, while they have different direct levels. Particularly, when both pumps are running, the ratio of the difference between two levels to the higher level may be less than the Primary On versus Paired Off percent constant and Paired On versus Primary Off percent constant.

Also, as mentioned earlier, the Primary On-State deviation percent constant and Paired Off-State deviation percent constant may be used to confirm that the operating state 1 has existed continuously for a predefined period of time, such as for three hours in one example. In one embodiment, three hour deviation of the primary direct divided by the average of three hour primary pump average and three hour paired pump average is calculated. The result may be less than the Primary On-State deviation percent, when the primary and paired pumps have been in the operating state 1 for three hours. Similarly, in another embodiment of the invention, three hour deviation of the paired direct divided by the average of three hour primary pump average and three hour paired pump average is calculated. The result may be less than the Paired Off-State deviation percent, when the primary and paired pumps have been in the operating state 1 for three hours.

Furthermore, as mentioned earlier, the Paired On-State deviation percent constant and Primary Off-State deviation percent constant may be used to confirm that the operating state 2 has existed continuously for a period of time, such as for three hours in on example. In one embodiment of the invention, three hour deviation of the paired direct divided by the average of three hour primary pump average and three hour paired pump average is calculated. The result may be less than the Paired On-State deviation percent. Similarly, in another embodiment of the invention, three hour deviation of the primary direct divided by the average of three hour primary pump average and three hour paired pump average may be less than the Primary Off-State deviation percent, when the primary and paired pumps have been in the operating state 2 for three hours.

In accordance with an embodiment of the invention, in case the condition involving Primary On-State deviation percent or Primary Off-State deviation percent is not met, the primary direct data from the last three hours may not contribute to further evaluation of the primary On/Off thresholds. Similarly, in case the condition involving Paired On-State deviation percent or Paired Off-State deviation percent is not met, the paired direct data from the last three hours may not contribute to further evaluation of the paired On/Off thresholds. However, violating any of the two conditions do not necessarily infer that the operating state 1 or operating state 2 is interrupted by another operating state during the last three hours.

Moreover, on day 3 the amplitudes of the vibration measurements of the primary and paired pumps transition to the other operating state. In other words, the operating state of the primary pump transitions from running to stopped and the operating state of the paired pump transitions from stopped to running.

Line 402 indicates the primary on state level and represents the minimum amplitude of vibration measurements of the primary pump during operating state 1. Line 404 indicates the primary off state level and represents the maximum amplitude of vibration measurements of the primary pump during operating state 2. Line 406 indicates the primary on state threshold and represents an average of the primary on state level and primary off state level.

Similarly, line 408 indicates the paired on state level and represents the minimum amplitude of vibration measurements of the paired pump during operating state 2. Line 410 indicates the paired off state level and represents the maximum amplitude of vibration measurements of the paired pump during operating state 1 Finally, line 412 indicates the paired on state threshold and represents an average of the paired on state level and paired off state level.

Thus, in one embodiment using the primary and paired on state thresholds to determine operating states, when the primary direct amplitude 414 is approximately at or above the primary on state threshold represented by line 406, it may be determined that the primary pump is operating, and when the paired direct amplitude 416 is approximately at or above the paired on state threshold represented by line 412, it may be determined that the paired pump is operating. In other embodiments, however, it is appreciated that other thresholds and pump operating conditions may be used to determine the operating state of the pumps.

FIG. 5 illustrates by way of a block diagram an example controller 102 used to implement the pump operating state system, according to one example embodiment of the invention. More specifically, the elements of the computerized controller 102 may be used to execute the operating state rules to determine the operating states of a plurality of pumps as described in detail herein. The computerized controller 102 may include a memory 516 that stores programmed logic 512 (e.g., software) and may store data 514, such as vibration measurement, predetermined conditions, and the operating state rules, for example. The memory 516 may also include an operating system 510. A processor 508 may utilize the operating system 510 to execute the programmed logic 512, and in doing so, also may utilize the data 514. The processor 508 may be a high-speed processor that meets the high-speed requirements for calculating the averages of vibration measurements of the plurality of pumps over small time intervals during the operation of these pumps. A data bus 506 may provide communication between the memory 516 and the processor 508. Users may interface with the controller 102 via a user interface device(s) 504, such as a keyboard, mouse, control panel, or any other devices capable of communicating data to and from the controller 102. The controller 102 may be in communication with one or more pumps, pump sensors, other controllers, other systems, and the like, via one or more input/output ("I/O") interfaces 502. More specifically, one or more of the controllers 102 may carry out the execution of the operating states rules analysis, such as, but not limited to, receiving vibration data from a plurality of sensors associated with a plurality of pumps, determining the operating states of the plurality of pumps based at least in part on the vibration data, and generating and/or transmitting a control action in response. Additionally, it is to be appreciated that other external devices or other pumping systems may be in communication with the controller 102 via the I/O interface(s) 502. In one example embodiment, the controller 102 may be located remotely with respect to the machine(s); although, it may be co-located or even integrated with the pumps or other devices being monitored. Further, the controller 102 and the programmed logic 512 implemented thereby may include software, hardware, firmware, or any combination thereof. It is also to be appreciated that multiple controllers 102 may be used, whereby different features described herein may be executed on one or more different controllers 102.

Manual analysis of historical data to set the threshold value is time consuming. Moreover, obtaining the correct operating states of the pumps installed on a common foundation in real time is essential for optimizing the pump performance. The systems and methods described herein have a technical effect of determining the operating states of the pumps installed on a common foundation. The systems and methods have a further technical effect of calculating the threshold value online, using the recent vibration data for real time, near real time, or subsequent analyses.

Embodiments of the invention are described above with reference to block diagrams and schematic illustrations of methods and systems according to embodiments of the invention. It will be understood that each block of the diagrams and combinations of blocks in the diagrams can be implemented by computer program instructions. These computer program instructions may be loaded onto one or more general purpose computers, special purpose computers, or other programmable data processing apparatus to produce machines, such as the controller 500 described with reference to FIG. 5, such that the instructions which execute on the computers or other programmable data processing apparatus create means for implementing the functions specified in the block or blocks. Such computer program instructions may also be stored in a computer-readable memory that can direct a computer or other programmable data processing apparatus to function in a particular manner, such that the instructions stored in the computer-readable memory produce an article of manufacture including instruction means that implement the function specified in the block or blocks.

While the invention has been described in connection with what is presently considered to be the most practical and various embodiments, it is to be understood that the invention is not to be limited to the disclosed embodiments, but on the contrary, is intended to cover various modifications and equivalent arrangements included within the spirit and scope of the appended claims.

This written description uses examples to disclose the invention, including the best mode, and also to enable any person skilled in the art to practice the invention, including making and using any devices or systems and performing any incorporated methods. The patentable scope the invention is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of monitoring a plurality of pumps, comprising: receiving, by a controller from a first sensor in communication with a first pump, a first vibration measurement during a period of time; receiving, by the controller from a second sensor in communication with a second pump, a second vibration measurement during the period of time; based at least in part on the first vibration measurement, determining a first operating condition associated with the first pump, wherein the first operating condition comprises a first threshold associated with the first pump; based at least in part on the second vibration measurement, determining a second operating condition associated with the second pump, wherein the second operating condition comprises a second threshold associated with the second pump; determining that the first pump is in a running operation state if the first vibration measurement is at or above the first threshold and in a stopped operation state if the first vibration measurement is below the first threshold; determining that the second pump is in a running operation state if the second vibration measurement is at or above the second threshold and in a stopped operation state if the second vibration measurement is below the second threshold, wherein the controller is operable to adjust the first operating condition and the second operating condition based on vibration measurements of the first pump and the second pump; and transmitting a control action responsive to the respective operation states of the first pump and the second pump.

2. The method of claim 1, wherein the first threshold is based at least in part on an average of at least one historical minimum vibration measurement of the first pump when operating and at least one historical maximum vibration measurement of the first pump when not operating, and wherein the second threshold is based at least in part on an average of at least one historical minimum vibration measurement of the second pump when operating and at least one historical maximum vibration measurement of the second pump when not operating.

3. The method of claim 1, wherein the first operating condition is associated with the second pump and the second operating condition is associated with the first pump.

4. The method of claim 1, further comprising receiving, by the controller, a first plurality of vibration measurements from the first sensor and a second plurality of vibration measurements from the second sensor over the period of time, wherein determining the respective operating states of the first pump and the second pump further comprises:

determining a first average of the first plurality of vibration measurements over the period of time and determining a second average of the second plurality of vibration measurements over the period of time, wherein the respective operating states of the first pump and the second pump are based at least in part on a comparison of the first average and the second average.

5. The method of claim 1, further comprising:

adjusting the first vibration measurement based at least in part on a first predetermined constant, wherein the first predetermined constant is based at least in part on historical vibration measurements of the first pump; and adjusting the second vibration measurement based at least in part on a second predetermined constant, wherein the second predetermined constant is based at least in part on historical vibration measurements of the second pump.

6. The method of claim 1, wherein the period of time comprises a first period of time, and further comprising:

receiving, by the controller, a first plurality of vibration measurements from the first sensor and a second plurality of vibration measurements from the second sensor during a second period of time;

determining the operating state of the first pump over the second period of time based at least in part on the variation of the first plurality of vibration measurements; and determining the operating state of the second pump over the second period of time based at least in part on the variation of the second vibration plurality of measurements;

wherein the second period of time is greater than the first period of time.

7. A system for monitoring a plurality of pumps, comprising:

a first sensor in communication with a first pump; a second sensor in communication with a second pump; and a controller in communication with the first sensor and the second sensor, and comprising instructions operable to: receive a first vibration measurement from the first sensor during a period of time; receive a second vibration measurement from the second sensor during the period of time; based at least in part on the first vibration measurement, determine a first operating condition associated with the first pump, wherein the first operating condition comprises a first threshold associated with the first pump; based at least in part on the second vibration measurement, determine a second operating condition associated with the second pump, wherein the second operating condition comprises a second threshold associated with the second pump; determine that the first pump is in a running operation state if the first vibration measurement is at or above the first threshold and in a stopped operation state if the first vibration measurement is below the first threshold; determine that the second pump is in a running operation state if the second vibration measurement is at or above the second threshold and in a stopped operation state if the second vibration measurement is below the second threshold, wherein the controller is operable to adjust the first operating condition and the second operating condition based on vibration measurements of the first pump and the second pump; and transmit a control action responsive to the respective operation states of the first pump and the second pump.

8. The system of claim 7, wherein the controller is further operable to:

determine the first threshold based at least in part on an average of at least one historical minimum vibration measurement of the first pump when operating and at least one historical maximum vibration measurement of the first pump when not operating; and determine the second threshold based at least in part on an average of at least one historical maximum vibration measurement of the second pump when not operating.

9. The system of claim 7, wherein the first operating condition is associated with the second pump and the second operating condition is associated with the first pump.

10. The system of claim 7, wherein the controller is further operable to:

receive a first plurality of vibration measurements from the first sensor and a second plurality of vibration measurements from the second sensor over the period of time; and determine a first average of the first plurality of vibration measurements over the period of time and determine a second average of the second plurality of vibration measurements over the period of time wherein, the respective operating states of the first pump and the second pump are based at least in part on a comparison of the first average and second average.

11. The system of claim 7, wherein the controller is further operable to:

adjust the first vibration measurement based at least in part on a first predetermined constant, wherein the first predetermined constant is based at least in part on historical vibration measurements of the first pump; and adjust the second vibration measurement based at least in part on a second predetermined constant, wherein the second predetermined constant is based at least in part on historical vibration measurements of the second pump.

12. The system of claim 7, wherein the period of time comprises a first period of time, and wherein the controller is further operable to:

receive a first plurality of vibration measurements from the first sensor and a second plurality of vibration measurements from the second sensor during a second period of time;

determine the operating state of the first pump over the second period of time based at least in part on the variation of the first plurality of vibration measurements; and determine the operating state of the second pump over the second period of time based at least in part on the variation of the second plurality of vibration measurements;

wherein the second period of time is greater than the first period of time.

13. The system of claim 7, wherein the first pump comprises a primary pump and the second pump comprises a paired pump.

14. The system of claim 7, wherein the first sensor and the second sensor each comprises an accelerometer operable to detect respective vibration of the first pump and the second pump.

15. The system of claim 7, further comprising a monitor system in communication with the first sensor and the second sensor and the controller, and operable to receive respective vibration measurements from the first sensor and the second sensor and to transmit the received vibration measurements to the controller.

16. A method for monitoring a pump, comprising:

receiving by a controller from a sensor in communication with a pump, a vibration measurement during a period of time;

based at least in part on the vibration measurement, determining at least one operating condition associated with the pump, wherein the at least one operating condition comprises a threshold associated with the pump;

determining that the pump is in a running operation state if the vibration measurement is at or above the threshold and in a stopped operation state if the vibration measurement is below the threshold, wherein the controller is operable to adjust the at least one operating condition based on vibration measurement of the pump; and transmitting a control action responsive to the operation state of the pump.

* * * * *

UNITED STATES PATENT AND TRADEMARK OFFICE

CERTIFICATE OF CORRECTION

PATENT NO. : 8,676,387 B2
APPLICATION NO. : 12/250154
DATED : March 18, 2014
INVENTOR(S) : Olga Malakhova et al.

It is certified that error appears in the above-identified patent and that said Letters Patent is hereby corrected as shown below:

In the Specification

Column 4, Line 42, please delete "10" and insert therefor --110--.

Signed and Sealed this
Ninth Day of September, 2014

Michelle K. Lee

Michelle K. Lee
*Deputy Director of the United States Patent and Trademark Office*